United States Patent [19]

Ashton

[11] Patent Number: 4,785,880

[45] Date of Patent: Nov. 22, 1988

[54] APPARATUS FOR DISPENSING CHEMICALS INTO OIL AND GAS WELLS

[76] Inventor: Robert Ashton, 630 Hassler Rd., Spring, Tex. 77379

[21] Appl. No.: 62,126

[22] Filed: Jun. 12, 1987

[51] Int. Cl.[4] ..... E21B 23/08; E21B 33/068; E21B 37/06

[52] U.S. Cl. ..... 166/53; 166/70; 166/75.1; 137/268; 15/3.5

[58] Field of Search ..... 166/53, 70, 75.1, 902; 15/104.062, 3.5, 3.52; 137/268; 221/15, 188; 222/639, 162, 168, 168.5

[56] References Cited

U.S. PATENT DOCUMENTS

| | | | |
|---|---|---|---|
| 2,713,909 | 7/1955 | Baker | 166/70 |
| 3,039,531 | 6/1962 | Scott | 166/70 |
| 3,160,210 | 12/1964 | Brewer | 166/75 |
| 3,164,206 | 1/1965 | Sharp | 166/38 |
| 3,211,225 | 10/1965 | Thiessen et al. | 166/75 |
| 3,218,659 | 11/1965 | Rowley | 166/70 |
| 3,396,789 | 8/1968 | Dean | 166/5 |
| 3,403,729 | 10/1968 | Hickey | 166/75.1 |
| 4,235,849 | 11/1980 | Handeland | 166/75.1 |
| 4,694,900 | 9/1987 | Behrens | 166/75.1 |

*Primary Examiner*—Stephen J. Novosad
*Assistant Examiner*—Bruce Kisliuk
*Attorney, Agent, or Firm*—Ben D. Tobor

[57] ABSTRACT

An apparatus for automatically dispensing chemicals into the well bore of a hydrocarbon producing well utilizes a double acting cylinder and piston to sequentially operate a plurality of valves associated with the well. The handles of each valve have a spring steel tine secured thereto which engages with a portion of the piston shaft which actuates the operation of each valve.

16 Claims, 3 Drawing Sheets

Fig. 1
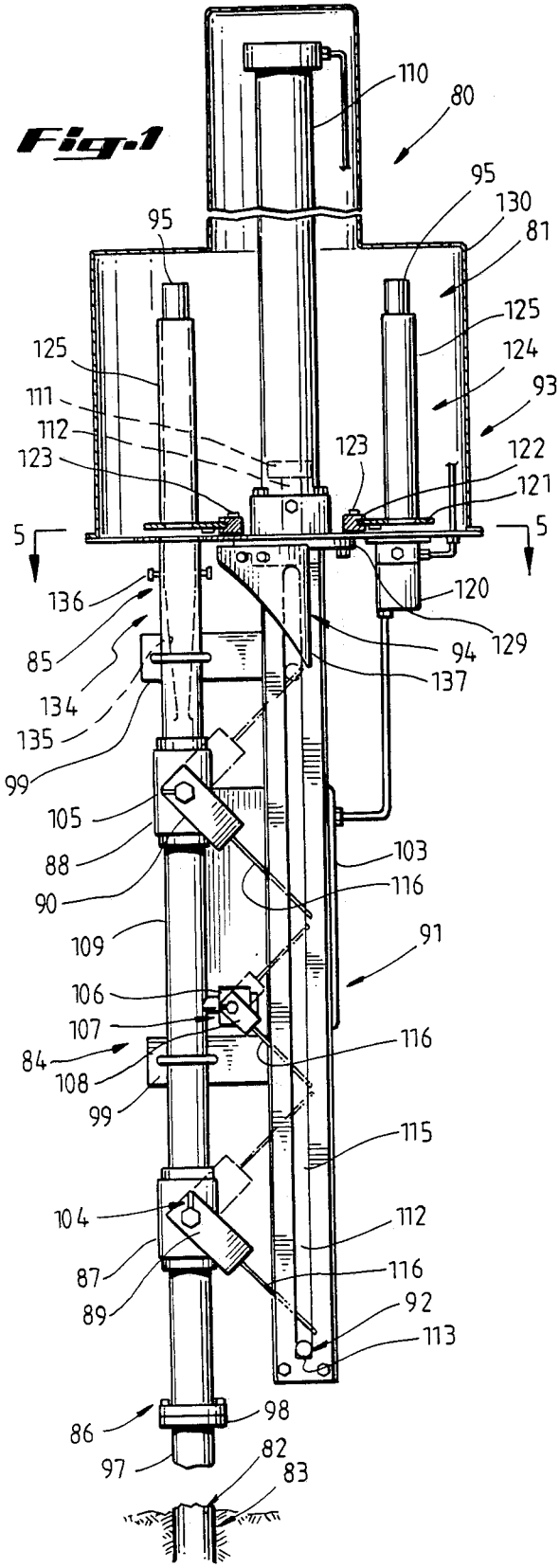
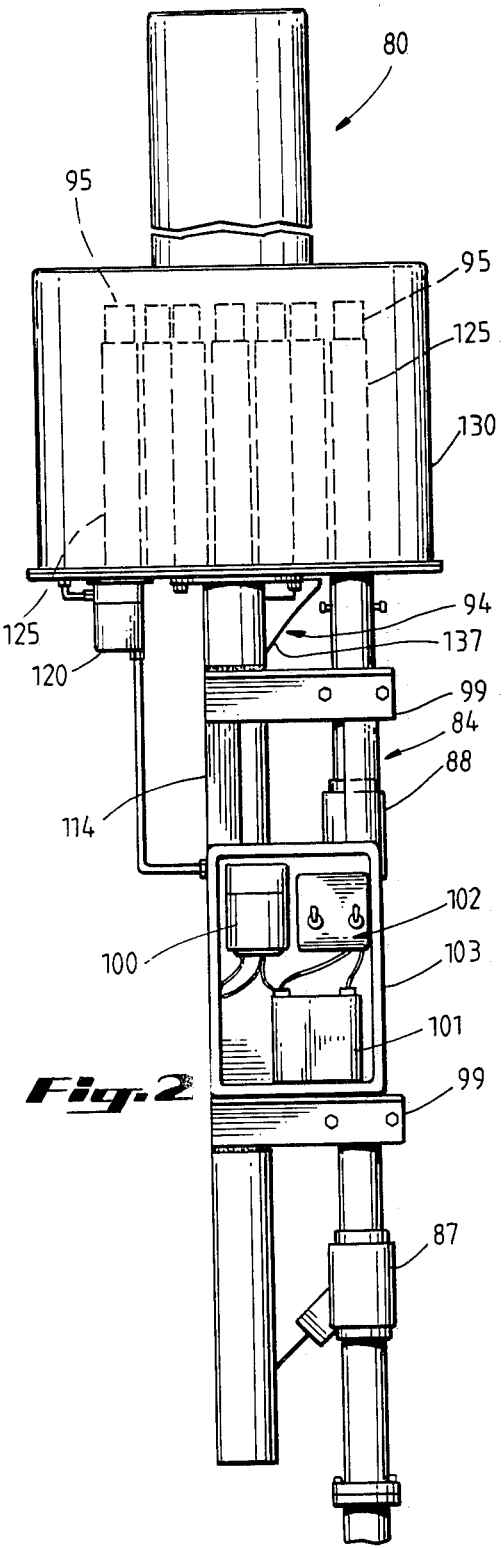
Fig. 2

APPARATUS FOR DISPENSING CHEMICALS INTO OIL AND GAS WELLS

FIELD OF THE INVENTION

The invention relates to an apparatus for automatically dispensing chemicals into the well bore of a hydrocarbon producing well, particularly chemicals formed as cylindrical sticks.

DESCRIPTION OF THE PRIOR ART

When a well producing natural gas, or natural gas and oil becomes partly drowned by water collecting in the well until it stands therein as a quiescent column, the water must be removed in order that sufficient production of hydrocarbons from the well can be secured. This is sometimes also true of wells producing oil in which the oil accumulates in a column until its exerts sufficient pressure on the formation to prevent the gas from entering the well and lightening the oil sufficiently so that it will flow. In an oil or gas well which produces water, it is a fairly frequent occurrence that the water will accumulate even while the well is flowing gas until the well becomes so filled with water that all production from it will cease. This type of well generally is known as a "drowned" well.

One method to obtain production from such wells is to periodically pump the water from the well bore which is an operation commonly referred to as "swabbing" the well. With respect to a low capacity well, or marginal well, the high costs associated with swabbing the well may be cost prohibitive, whereby the economics of producing such a well cannot justify the expense involved in swabbing the well.

In wells in which there has been some production of gas still continuing despite accumulated water, another method to continue production from such a well is to add to the well a foaming agent, such as a water-soluble, or water and oil soluble, surfactant, such as soap in cylindrical shaped sticks. The stick shaped chemicals, or soap sticks as they are frequently referred to, may employ a product such as urea as a binder and a quantity of dense material such as barite to make the sticks sink in liquids such as brine. Surfactants contained in such soap sticks have been very effective in lowering the surface tension of the water and are capable of producing large volumes of foam when the well is producing some gas. The gas entering the well bore will cause large volumes of foam in the water which has had its surface tension reduced because of the surfactant, and this foam travelling upward in the well bore will carry the water contained therein to the surface for disposal by conventional methods. It should be noted that other chemicals, such as corrosion inhibitors, surfactants, and lubricants, are also manufactured in stick form and may also be dropped into the well bore of various types of wells, such as gas storage wells, salt water disposal wells, and/or chemical disposal wells.

In the case of soap sticks, they must be dispensed into the well bore at prescribed time intervals which have been determined based upon experience with the given well in which the soap sticks are to be dispensed. If the prescribed time intervals are not followed, the well can cease to produce hydrocarbons due to the water build up in the well bore. The major disadvantage associated with dispensing soap sticks into the well bore, as well as the other types of chemicals which are manufactured in stick form, is that the process has not been automated.

At the present time, chemicals manufactured in stick form are dispensed into a well by an individual who visits each well site on a prescribed schedule in accordance with the prescribed time interval when the soap stick must be dispensed into the well bore. The individual would typically find above a conventional valve manifold, or Christmas tree, on the well head a conventional ball valve with a section of pipe extending upwardly therefrom. The section of pipe would typically have a small vent valve in the side of it, and it is provided with a screw-on pressure cap at the upper end of the section of pipe. The individual would first close the ball valve to seal off the section of pipe, after which the vent valve would be opened to relieve any gas pressure contained in the section of pipe. The individual would then unscrew the pressure cap from the top of the section of pipe and manually drop the soap stick into the section of pipe. The individual would then screw back on the pressure cap to the top of this section of pipe, close the vent valve, and finally open the ball valve to permit the soap stick to fall downwardly into the well bore. The individual would then get back into his vehicle and drive to the next well site to perform the same steps at the next well. Thus, it should be seen that the dispensing of chemicals into a well bore, which chemicals are formed in the shape of cylindrical sticks, has a substantial labor cost associated therewith, as well as the risks associated with the possibility that the individual would not dispense the stick shaped chemical into the well at the proper time interval which could result in the well ceasing to produce hydrocarbons due to undesired water build up in the well bore.

Accordingly, prior to the development of the present invention, there has been no apparatus for dispensing chemicals into the well bore of a hydrocarbon producing well which is simple and economical to manufacture and use, and which provides for the automatic dispensing of such chemicals over predetermined intervals of time. Therefore, the art has sought an apparatus for dispensing chemicals into the well bore of a hydrocarbon producing well which is simple and economical to manufacture and use, and automatically dispenses the chemicals into the well bore over predetermined intervals of time.

SUMMARY OF THE INVENTION

In accordance with the invention, the foregoing advantages have been achieved through the present apparatus for automatically dispensing chemicals into the well bore of a hydrocarbon producing well. The present invention includes: an elongate length of pipe, having upper and lower ends, in communication with the well bore; at least two valves associated with the length of pipe, each of the valves having a handle associated therewith for opening and closing the valve, one of the at least two valves being normally in a closed position, and the other of the at least two valves being normally in an open position; means for selectively actuating the handles of the at least two valves to alternately open and close the at least two valves, the selective actuation means including a valve operator member which is moveable in a direction substantially parallel with the longitudinal axis of the elongate length of pipe; means for filling a portion of the elongate of pipe with the chemicals, the filling means including at least one container of the chemicals; and means for actuating the filling means, the actuating means for the filling means being operable by the valve operator member; whereby movement of the valve operator member in a direction substantially parallel with the longitudinal axis of the elongate length of pipe, in turn, closes one of the at least two valves to isolate a portion of the length of pipe from the well bore, opens the other of the at least two valves to place the portion of the length of pipe in communication with the filling means, and engages the actuating means for the filling means to fill the portion of the pipe with the chemicals; and further movement of the valve operator member returns the at least two valves to their normal closed and opened positions whereby the portion of the length of pipe is in communication with the well bore and the chemicals fall into the well bore.

Another feature of the present invention is that the apparatus may include a vent valve having a handle associated therewith and being normally in a closed position, the vent valve being associated with the length of pipe and disposed between the at least two valves associated with the length of pipe, the portion of the pipe disposed between the at least two valves defining the portion of the length of pipe to be filled with the chemicals; the vent valve being adapted to outwardly vent any gases contained in the portion of the pipe disposed between the at least two valves, after the normally open valve has been closed. A further feature of the present invention is that the selective actuation means for the valve handles may include a double acting cylinder and piston, the piston having an elongate piston shaft; and the valve operator member is disposed on the piston shaft and extends outwardly from the piston shaft for engagement with the valve handles.

Another feature of the present invention is that the selective actuation means for the valve handles may include a spring steel tine associated with each valve handle; the tine being engageable with the valve operator member, whereby movement of the valve operator member moves the tine and associated valve handle, until the valve handle has been moved to force the valve into the desired opened or closed position, and further movement of the valve operator member past the tine is permitted by deflection of the tine, at which time the tine springs back into its undeflected configuration. An additional feature of the present invention is that the chemicals may be adapted to be formed into cylindrical sticks, and the at least one container includes a plurality of generally tubular members, adapted to receive the sticks; and the filling means includes a rotatable carrousel member, disposed above the length of pipe, upon which the tubular members are radially disposed, with the longitudinal axes of the tubular members lying in planes which are substantially parallel to the longitudinal axis of the length of pipe.

Another feature of the present invention is that the means for actuating the filling means may include a rotatable cam member, associated with the carrousel member, which is moved and engaged by the valve operator member to cause rotation of the carrousel member until a tubular member containing a cylindrical stick of chemicals is in alignment with the length of pipe, whereby the stick of chemicals may fall into the length of pipe. The upper end of the length of pipe may include means for controlling the fall of the stick of chemicals into the length of pipe and the control means may include at least one flexible blade member which is adapted to contact the stick of chemicals, whereby a frictional force is exerted upon the stick of chemicals to slow its fall into the length of pipe to prevent breakage of the stick.

The apparatus for automatically dispensing chemicals into the well bore of a hydrocarbon producing well of the present invention, when compared with previously proposed prior art apparatus and techniques, has the advantages of being simple and economical to manufacture and use, and provides automatic dispensing at predetermined intervals of time with a minimum amount of labor costs associated therewith.

BRIEF DESCRIPTION OF THE DRAWINGS

In the drawings:

FIG. 1 is a front view of an apparatus for automatically dispensing chemicals into the well bore of a hydrocarbon producing well in accordance with the present invention;

FIG. 2 is a back view of the apparatus of FIG. 1 of the present invention;

Figure 3:
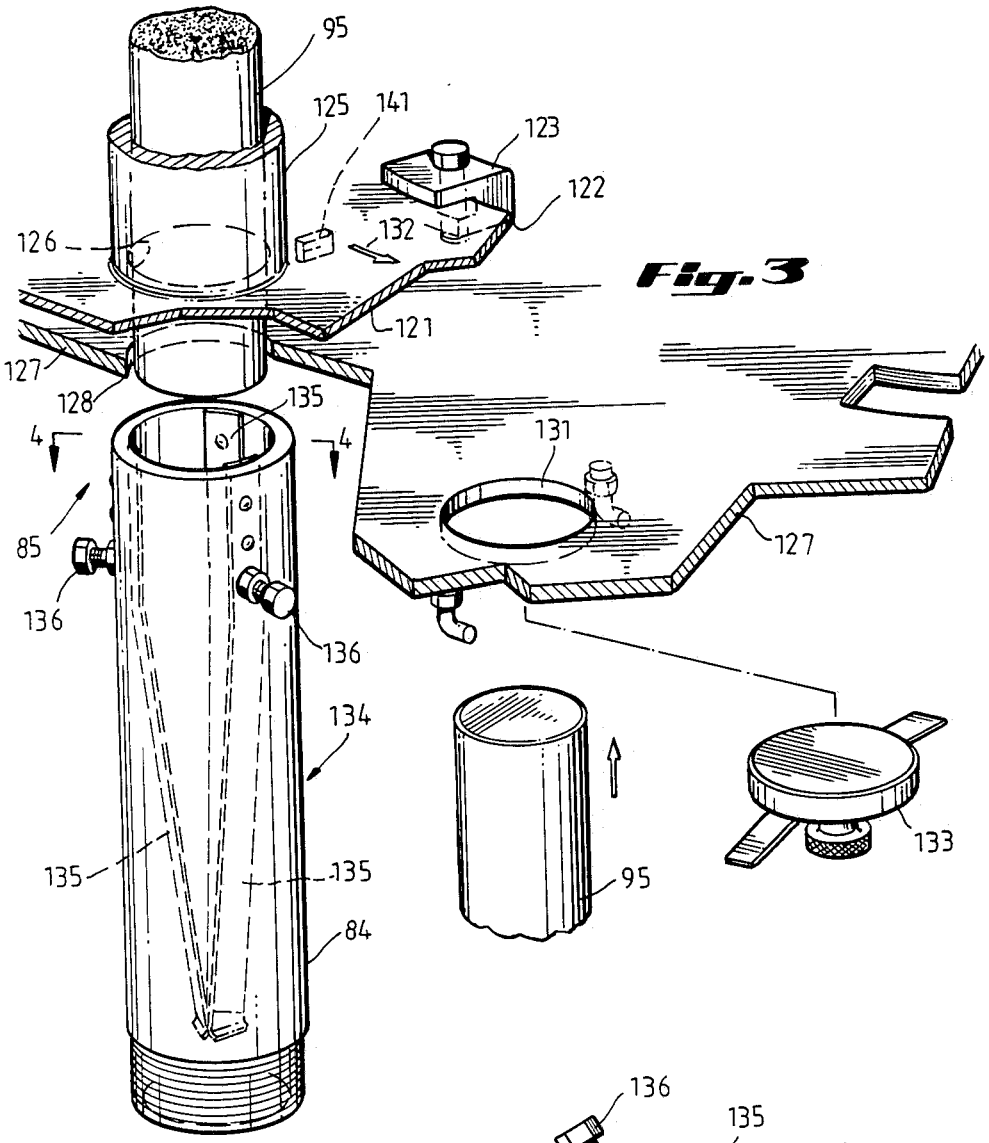
FIG. 3 is a partial cross-sectional, exploded view of a portion of the apparatus of the present invention.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the apended claims.

DETAILED DESCRIPTION OF THE INVENTION

In FIGS. 1 and 2, an apparatus 80 for automatically dispensing chemicals 81 into the well bore 82 of a hydrocarbon producing well 83 is shown to comprise: an elongate length of pipe 84 having upper and lower ends 85, 86 in communication with the well bore 82; at least two valves 87, 88, each of the valves having a handle 89, 90 associated therewith for opening and closing the valves 87, 88; means for selectively actuating 91 the handles 89, 90 of the at least two valves 87, 88, the selective actuation means 91 including a valve operator member 92; means for filling 93 a portion of pipe 84 with the chemicals 81; and a means for actuating 94 the filling means 93, the actuating means 94 for the filling means 93 being operable by the valve operator member 92.

Still with reference to FIGS. 1 and 2, it is seen that chemicals 81 may preferably be formed in conventional, cylindrical sticks 95, wherein sticks 95 include the desired chemical, such as a soap type foaming agent, a binder, and a quantity of dense material to make the sticks 95 sink downwardly from filling means 93 through the elongate length of pipe 84 and hence into the well bore 82 of well 83. When the sticks 95 contain a foaming agent and/or surfactant material, the sticks 95 are commonly referred to as "soap sticks". Additionally, it should be noted that the apparatus 80 of the present invention could also be utilized for dispensing chemicals 81, such as corrosion inhibitors or lubricants which can also be formed into cylindrical sticks 95. The dispensing apparatus 80 of the present invention can be readily installed upon the well head 97, as by bolting pipe 84 to well head 97, or other piping from the valve manifold (not shown) from well head 97, as by flanged fitting 98. The additional components of the automatic dispensing apparatus 80 may be fixedly secured to pipe 84 as by conventional U-bolt and bracket assemblies 99. Alternatively, pipe 84 can be bolted via flange fitting 98, as previously described, and the other components of dispensing apparatus 80 may be disposed adjacent pipe 84 in the configuration illustrated in FIGS. 1 and 2, by use of a suitable support stand (not shown), fabricated from conventional materials in a conventional manner. As seen in FIG. 2, a conventional control device, such as a programmable solid state timer 100 may be utilized to predetermine the time intervals for which the dispensing apparatus 80 will be utilized, as hereinafter set forth in greater detail. A conventional 12 volt dry cell battery 101 may be utilized to power timer 100, if electrical power is not available at the well site. Conventional on/off toggle switches 102 may be utilized in a conventional manner to control the operation of dispensing apparatus 80. Preferably, timer 100, battery 101, and switches 102 are contained within a conventional weatherproof box 103 to protect those components from the elements.

The valves 87, 88 are conventional full port ball valves, the first valve 87 being normally disposed in an open position as illustrated at 104, and the second valve 88 is normally disposed in a closed position, as indicated at 105. As illustrated in FIG. 1, when each valve is in its normal, operating position, handles 89, 90 are generally disposed in a downwardly and outwardly extending relationship with respect to pipe 84. As will be hereinafter described in greater detail, after valve handles 89, 90 have been actuated by selective actuation means 91, the valves 87, 88 will assume the positions shown in dotted lines in FIG. 1, wherein the valve handles 89, 90 are generally disposed in an outwardly, upwardly extending relationship with respect to pipe 84. Thus, when valves 87, 88 are disposed in their normal operating positions, the lower portion of pipe 84 extending from below valve 87 and upwardly to the bottom of valve 88 is sealed off by valve 88.

As will hereinafter be described in greater detail, a vent valve 106 of conventional construction may be between the first and second valves 87, 88 in fluid communication with pipe 84. Vent valve 106 is normally disposed in a closed position as illustrated at 107, and its handle 108 is normally disposed in a downwardly and outwardly extending relationship with respect to pipe 84. As illustrated in dotted lines in FIG. 1, when vent valve 106 is open, handle 108 is disposed in an upwardly and outwardly extending relationship with respect to pipe 84. When it is desired to dispense a chemical stick 95 into well bore 82, it is necessary to first close the first valve 87, so as to prevent the escape of gas and/or fluid from well bore 82. It is then preferable that any fluid and/or gas contained in the portion 109 of pipe 84 disposed between first and second valves 87, 88, be vented to the atmosphere as by opening vent valve 106. After the interior of the portion 109 of pipe 84 has been vented, valve 88 is opened so as to permit a chemical stick 95 to pass through valve 88 into the chemical stick chamber, or portion 109 of pipe 84, the details of the filling step performed by filling means 93 to be hereinafter described in greater detail. After the chemical stick 95 has fallen through valve 88 and passed into the chemical stick chamber 109, valve 88 must be closed, followed by the vent valve 106 being closed, both valves then being disposed in their normal operating positions. After both of those valves 88, 106 have been closed, it is then necessary to open valve 87, whereby the chemical stick 95 can pass downwardly through valve 87 and hence into well bore 82.

Figure 6:
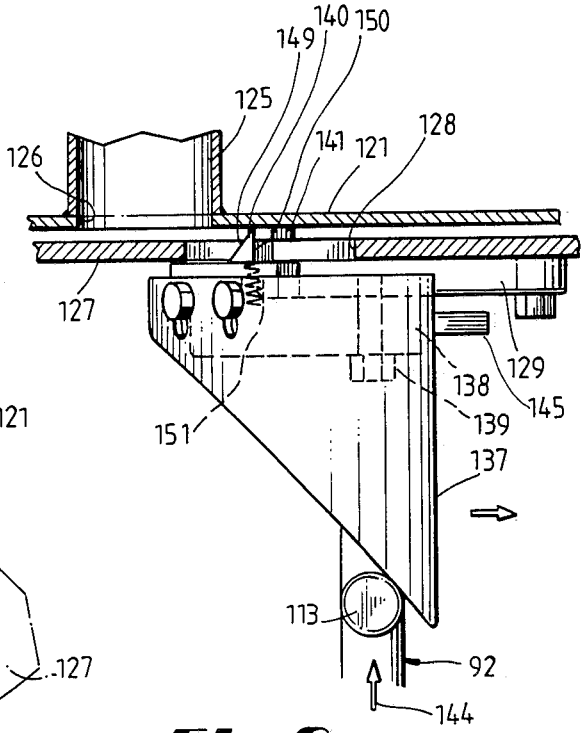
FIG. 6 is a partial cross-sectional view of a portion of the apparatus of the present invention.
Figure 7:
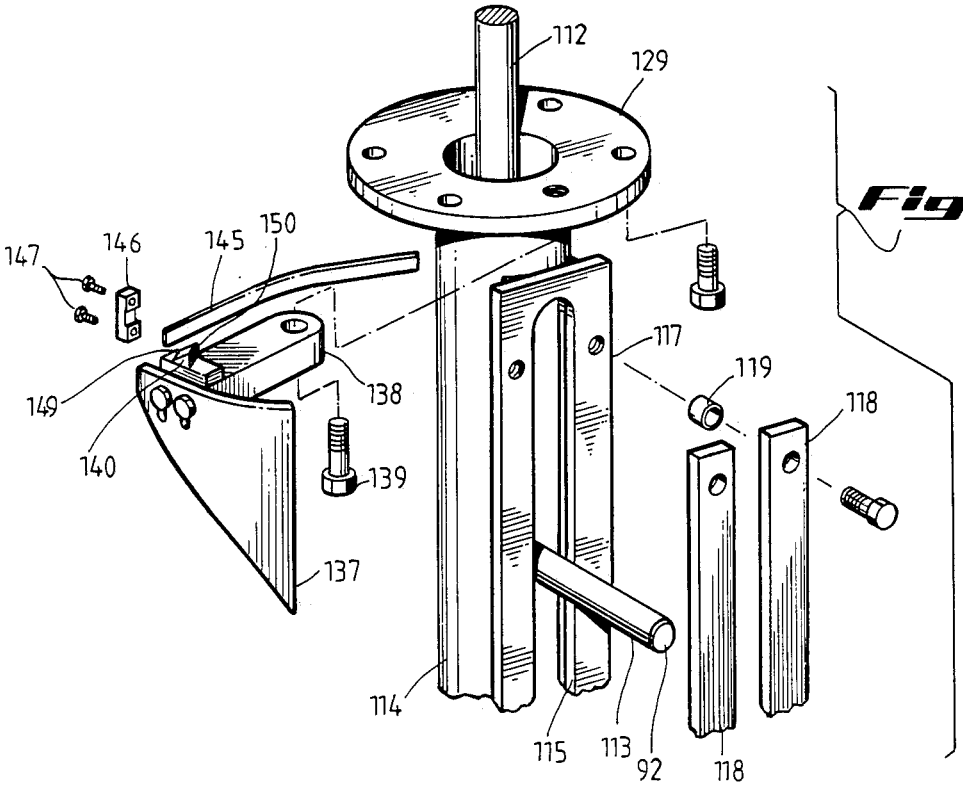
FIG. 7 is an exploded view of a portion of the apparatus of the present invention.

With reference to FIGS. 1 and 7, the selective actuation means 91 for the valve handles 89, 90, 108 of valves 87, 88, 106 will be described in greater detail. Selective actuation means 91 generally includes a double acting cylinder 110, and a piston 111 with an elongate piston shaft 112 fixedly secured thereto. At the bottom of piston shaft 112 is fixedly secured the valve operator member 92, which preferably is a metallic rod 113 fixedly secured to the lower end of piston shaft 112. Preferably, double acting cylinder 110 has a long stroke to provide the necessary movement of valve operator member 92 from the position shown in FIG. 1 in solid lines which is slightly below valve 87, to a position slightly above and beyond valve 88, as illustrated in dotted lines in FIG. 1. As will be hereinafter described in greater detail, valve operator member 92 must be capable of moving upwardly beyond the position shown in dotted lines in FIG. 1 to contact the actuation means 94 for filling means 93 as will be hereinafter described in greater detail in connection with FIG. 6.

Figure 5:
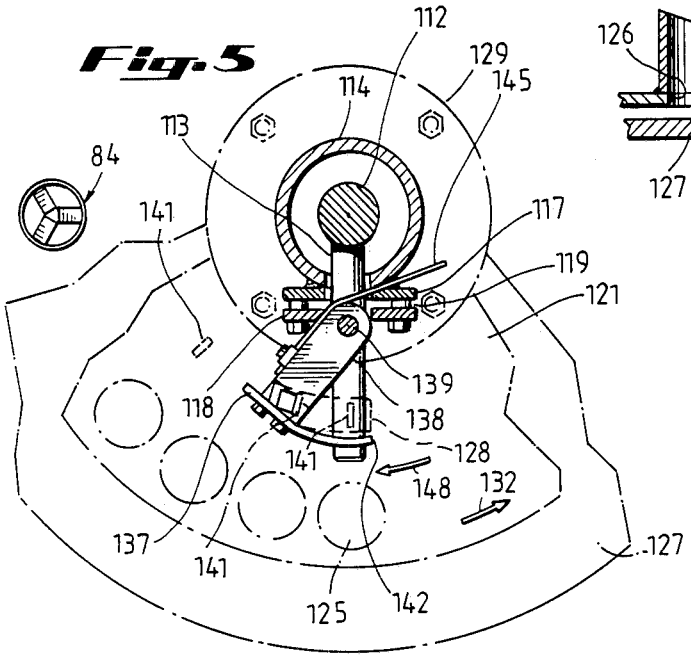
FIG. 5 is a partial cross-sectional view taken along line 5—5 of FIG. 1.

With reference to FIGS. 1, 5 and 7, it is seen that piston shaft 112 is guided, as by a tubular guide member 114 having a longitudinal slot 115 which permits the passage of valve operator member 92 therethrough. Additionally, if necessary, other guide bearing surfaces within guide member 114 could be provided to insure that piston shaft 112 is not unduly deflected. Preferably, selective actuation means 91 further includes a spring steel tine, or projection, 116 attached to each valve handle 89, 90, 108 with each tine 116 being engageable with the valve operator member 92. Preferably, a guide means for the spring steel tines, or projections, 116 is provided on tubular guide member 114, and is seen to include two spaced plate members 117, 118 secured to tubular guide member 114 with a plurality of spacer members 119 being disposed between the guide plate members 117, 118, whereby the spring steel tines 116 are disposed between the guide plate members 117, 118. Accordingly, valve operator member 92 moves upwardly or downwardly in response to upward or downward motion of piston shaft 112, and valve operator member 92 will engage each valve handle 89, 90, 108 via the spring steel tine 116 fixedly secured to each valve handle.

As valve operator member 92 engages the spring steel tine 116 associated with valve handle 89, as seen in FIG. 1, the upward movement will serve to first close valve 87 until valve handle 89 and spring steel tine 116 assume the position shown in dotted lines in FIG. 1. Further upward movement of valve operator member 92 will cause the spring steel tine 116 to be upwardly deflected to permit valve operator member 92 to continue its upward movement past spring steel tine 116. After valve operator member 92 has passed the spring steel tine 116 associated with valve handle 89, the spring steel tine 116 will spring back into its undeflected configuration illustrated in dotted lines in FIG. 1. Further upward movement of valve operator member 92 in response to the upward movement of piston shaft 112 will in turn likewise cause movement of the valve handles 108, 90 in the same manner until those valve handles 90, 108 assume the positions shown in dotted lines in FIG. 1. Likewise, subsequent downward movement of valve operator handle 92 will engage the spring steel tines 116 when they are disposed in the positions shown in dotted lines in FIG. 1, and the downward movement will cause the valve handles to assume the positions shown in solid lines in FIG. 1, as valve operator member 92 moves downwardly into engagement with each spring steel tine 116 until valve operator member 92 passes each of the spring steel tines 116. Upon completion of an upward and downward stroke, or complete cycle, of valve operator member 92 in response to motion of piston shaft 112, a single chemical stick 95 will be dispensed from filling means 93, in a manner to be hereinafter described in greater detail, downwardly into well bore 82. Alternatively, other flexible projections could be utilized in lieu of spring steel tines 116 in connection with selective actuation means 91. For example, a spring loaded cantilevered bar member, or tightly wound elongate coil spring, or other flexible members could be substituted, provided that the projection be flexible enough to deflect and permit the passage of the valve operator member past the projection, as well as be rigid enough to permit the valve operator member to initially engage the projection to move the valve handle into its desired position.

The operation of double acting cylinder 110 can be controlled in a variety of ways; however, it is preferred that a conventional four-way solenoid valve 120 (FIGS. 1 and 2) be utilized to control the operation of double acting cylinder 110. The four-way solenoid valve 120 is operatively associated with timer 100 in a conventional manner to stroke the piston 111 and its associated piston shaft 112 in and out of cylinder 110 in a conventional manner. Double acting cylinder 110 can be of any conventional pneumatic design and may be powered by either natural gas pressure from the well 83 or an alternate air or gas source (not shown). Alternatively, any other type of conventional power source could be utilized to move valve operator member 92, such as an electric motor or an air motor. Likewise, the movement of valve operator member could be accomplished by a conventional rack and pinion drive, power screw, or chain drive.

With reference now to FIGS. 1 and 3, the filling means 93 will be described in greater detail. Filling means 93 generally includes a rotatable carrousel member 121 which is disposed above pipe 84, and rotatable about double acting cylinder 110. Carrousel member 121 has a generally annular configuration (FIG. 5) the center internal surface 122 of carrousel member 121 being supported by a plurality of mounting brackets 123 which permit rotation of carrousel member 121 about cylinder 110. Filling means 93 further includes at least one container 124 for the chemicals 81, and preferably the at least one container 124 is comprised of a plurality of tubular members 125 adapted to receive chemical sticks 95 as seen in FIGS. 1 and 3. Mating openings 126, 128 are formed in annular shaped carrousel member 121 and carrousel lower housing plate 127, so that chemical sticks 95 can freely pass through tubular members 125 and through carrousel member 121 and carrousel lower housing plate 127.

Except when it is desired to dispense a chemical stick 95 downwardly from tubular member 125 into pipe 84 as will be hereinafter described in greater detail, the downward movement of chemical sticks 95 is restrained by the chemical sticks 95 abutting a carrousel lower housing plate 127. Carrousel lower housing plate 127 has an opening 128 formed therein in alignment with the upper open end 85 of pipe 84, which opening 128 also mates with openings 126, as those openings 126 and corresponding tubular members 125 are rotated and indexed into alignment with opening 128 in carrousel lower housing plate 127. Carrousel lower housing plate 127 is fixedly secured in the proper spaced relationship as by bolting carrousel lower housing plate 127 to a carrousel housing mounting flange 129 (FIG. 7) fixedly secured to the upper end of tubular guide member 114.

A housing 130 can be disposed about the tubular members 125 and carrousel member 121 in order to protect the chemicals 81 from the effects of the environment. Weatherproof carrousel housing 130 can be removeably secured to the carrousel lower housing plate 127 in any suitable manner such as by screws or bolts, and it is preferred that housing 130 be vented in a conventional manner. The carrousel lower housing plate 127 may be provided with another opening or filler port 131 which opening, or filler port, 131 is radially spaced from chemical exit opening 128 and is in alignment with openings 126 of tubular members 125 when the openings 126 and related tubular members 125 are rotated to be disposed over filler port 131. As will be hereinafter described in greater detail, the carrousel member 121 of filling means 93 is adapted to be rotated in a counterclockwise fashion, as seen from the top of housing 130, and as shown by arrow 132 in FIGS. 3 and 5. Accordingly, as carrousel member 121 is rotated, an empty tubular member 125 would be presented over filler port 131, whereby an empty tubular member 125 of filing means 93 could be reloaded by upwardly pushing a chemical stick 95 through filler port 131 and into tubular member 125, as shown in FIG. 3. A suitable closure 133 can be provided to seal filler port 131 when not in use. Filler port 131 does permit refilling of the tubular members 125 of chemical container 124 without the necessity of removing vented, weatherproof housing 130.

Figure 4:
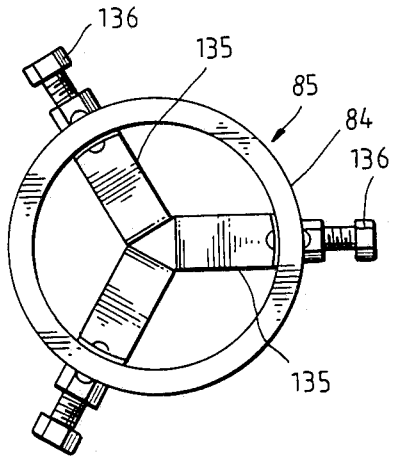
FIG. 4 is a top view of a portion of the apparatus of the present invention taken along line 4—4 of FIG. 3.

As seen in FIGS. 1, 3 and 4, the upper end 85 of pipe 84 disposed between valve 88 and the carrousel lower housing plate 127 may include means for controlling 134 the fall of the stick 95 of chemicals 81 into pipe 84 to prevent breakage of the stick 95. Preferably, the control means 134 includes at least one flexible blade member 135, which is adapted to contact the stick 95 of chemicals 81 to exert a frictional force upon the stick 95 to slow its fall into pipe 84. As seen in FIGS. 3 and 4, three blade members 135 are circumferentially disposed within pipe 84 and are provided with suitable tensioning screws 136, to adjust the movement of the blade members 135 inwardly or outwardly to compensate for varying weights of the chemical sticks 95.

With reference now to FIGS. 1, 5 and 6, the actuating means 94 for filling means 93 will be described in greater detail. A curved cam member 137 is secured to the carrousel lower housing plate 127 via a cam arm 138 which is rotatably mounted about a pivot bolt 139 which is received in carrousel mounting flange 129. Actuation means 94 further includes a spring-biased ratchet dog 140 which is mounted on cam arm 138, whereby ratchet dog 140 can engage with a plurality of mating depending keys 141 which are disposed on the bottom of the carrousel member 121. As seen in FIG. 5, a slot 142 is formed in the carrousel lower housing plate 127 to permit passage of the ratchet dog 140 to contact keys 141 as ratchet dog 140 is rotated via the rotation of cam 137 and cam arm 138 about pivot pin bolt 139, as seen in FIG. 6, caused by valve operator member 92 moving upwardly in the direction shown by arrow 144. Valve operator member 92, or rod 113, will contact the curved cam member 137 which in turn causes curved cam member 137 to rotate about pivot pin 139. Ratchet dog 140 in turn contacts and engages key 141, which in turn rotates carrousel member 121.

When valve operator member 92 reaches the top of its upward movement, as caused by the upward movement of piston shaft 112, further rotation of cam member 137 stops and valve operator member 92 begins to move downwardly away from cam member 137. Curved cam member 137 is preferably spring-biased, as by a blade spring 145 which is secured to cam arm 138 by a cam spring bracket 146 which is secured to cam arm 138 by a plurality of screws 147. As seen in FIG. 5, the other end of cam spring 145 abuts against tubular guide member 114. Thus, upon valve operator member 92 moving downwardly, cam arm spring 145 biases cam arm 137 to move clockwise in the direction of arrow 148 as viewed from the top in FIG. 5 to assume its original position. As curved cam member 137 rotates in the direction of arrow 148, as previously described, the trailing surface 149 of ratchet dog 140 will contact the next key 141 which is to be contacted by the front surface 150 of ratchet dog 140. To permit ratchet dog 140 to pass beneath the next key 141, ratchet dog 140 is spring-biased by a spring 151 to permit ratchet dog 140 to move downwardly to permit it to pass beneath the next key 141 and assume the position shown in FIG. 6. The keys 141 are radially spaced and attached to the underside of carrousel member 121, so that movement of valve operator member 92 in the manner previously described will serve to rotate carrousel member 121 to index and align tubular members 125 with the opening 128 formed in the carrousel lower housing plate 127, which in turn permits the chemical stick 95 to pass downwardly into the upper end 85 of pipe 84 as previously described.

In addition to the control device, or timer 100, previously described, other means to control the selective actuation means 91 could be utilized. For example, a pressure switch could be associated with the well bore, which switch could monitor the flowing pressure of the well. A drop in the pressure of the well, which would likely indicate a build-up of fluid in the well bore and a drop in gas flow, could thus activate a complete cycle of the automatic dispensing apparatus 80, or an upward and downward stroke of piston 111 and piston shaft 112 within cylinder 110. Other types of flow measurement devices could also be used to measure a drop in the gas flow and, in turn initiate a signal to start a complete cycle of the automatic dispensing apparatus 80. Additionally, for some wells, the well must be shut-in in order for chemical sticks to drop into the well because the gas velocity coming out of the well bore will not allow the chemical stick to drop by gravity, or the well may be shut in to allow the chemicals 81 to mix with the well fluids for a period of time prior to reflowing the well. An additional flow valve with a conventional operator and timer could be controlled in a conventional manner using timers in order to shut-in the well while the automatic dispensing apparatus 80 of the present invention is utilized.

It is to be understood that the invention is not limited to the exact details of construction, operation, exact materials or embodiment shown and described, as obvious modifications and equivalents will be apparent to one skilled in the art; for example, the tubular members used as a container for the chemicals could be filled with powdered chemicals and the space between the bottom of the tubular container member could be sealed with respect to the carrousel lower housing plate as by a flexible skirt gasket. Accordingly, the invention is therefore to be limited only by the scope of the appended claims.

I claim:

1. An apparatus for automatically dispensing chemicals into a well bore of a well comprising:

an elongate length of pipe, having upper and lower ends, in communication with the well bore;

at least two valves associated with the length of pipe, each of the valves having a handle associated therewith for opening and closing the valve, one of the at least two valves being normally in a closed position, and the other of the at least two valves being normally in an open position;

means for selectively actuating the handles of the at least two valves to alternately open and close the at least two valves, the selective actuation means including a valve operator member which is moveable in a direction substantially parallel with the longitudinal axis of the elongate length of pipe;

means for filling a portion of the elongate length of pipe with the chemicals, the filling means including at least one container of the chemicals; and means for actuating the filling means, the actuating means for the filling means being operable by the valve operator member; whereby movement of the valve operator member in a direction substantially parallel with the longitudinal axis of the elongate length of pipe, in turn, closes one of the at least two valves to isolate a portion of the length of pipe from the well bore, opens the other of the at least two valves to place the portion of the length of pipe in communication with the filling means, and engages the actuating means for the filling means to fill the portion of the pipe with the chemicals; and further movement of valve operator member returns the at least two valves to their normal closed and open positions whereby the portion of the length of pipe is in communication with the well bore and the chemicals fall into the well bore.

2. The apparatus of claim 1, further including a vent valve having a handle associated therewith and being normally in a closed position, the vent valve being associated with the length of pipe and disposed between the at least two valves associated with the length of pipe, the portion of the pipe disposed between the at least two valves defining the portion of the length of pipe to be filled with the chemicals; the vent valve being adapted to outwardly vent any gases contained in the portion of the pipe disposed between the at least two valves, after the normally open valve has been closed.

3. The apparatus of claim 1, wherein the selective actuation means for the valve handles includes a double acting cylinder and piston, the piston having an elongate piston shaft; and the valve operator member is disposed on the piston shaft and extends outwardly from the piston shaft for engagement with the valve handles.

4. The apparatus of claim 2, wherein the selective actuation means for the valve handles further includes a spring steel tine associated with each valve handle; the tine being engageable with the valve operator member, whereby movement of the valve operator member moves the tine and associated valve handle, until the valve handle has been moved to force the valve into the desired open or closed position, and further movement of the valve operator member past the tine is permitted by deflection of the tine, at which time the tine springs back into its undeflected configuration.

5. The apparatus of claim 1, wherein the chemicals are adapted to be formed into cylindrical sticks, and the at least one container includes a plurality of generally tubular members, adapted to receive the sticks; and the filling means includes a rotatable carrousel member, disposed above the length of pipe, upon which the tubular members are radially disposed, with the longitudinal axes of the tubular members lying in planes which are substantially parallel to the longitudinal axis of the length of pipe.

6. The apparatus of claim 5, wherein the means for actuating the filling means includes a rotatable cam member, associated with the carrousel member, which is moved and engaged by the valve operator member to cause rotation of the carrousel until a tubular member containing a cylindrical stick of chemicals is in alignment with the length of pipe, whereby the stick of chemicals may fall into the length of pipe.

7. The apparatus of claim 6, wherein the upper end of the length of pipe includes means for controlling the fall of the stick of chemicals in the length of pipe.

8. The apparatus of claim 7, wherein the means includes at least one flexible blade member which is adapted to contact the stick of chemicals, whereby a frictional force is exerted upon the stick of chemicals to slow its fall into the length of pipe to prevent breakage of the stick.

9. The apparatus of claim 5, including a housing disposed about the plurality of tubular members and the carrousel member to protect the chemicals contained therein from the effects of the environment, and the housing includes a filler port, disposed below the carrousel member, whereby empty tubular members can be refilled with chemicals without the necessity of removing the housing.

10. The apparatus of claim 6, wherein the cam member is spring biased.

11. The apparatus of claim 1, including means for controlling when the selective valve handle actuation means is operated.

12. The apparatus of claim 3, wherein the selective actuation means for the valve handles further includes a flexible projection associated with each valve handle; the flexible projection being engageable with the valve operator member, whereby movement of the valve operator member moves the flexible projection, until the valve handle has been moved to force the valve into the desired open or closed position, and further movement of the valve operator member past the flexible projection is permitted by deflection of the flexible projection, at which time a flexible projection moves back into its undeflected configuration.

13. An apparatus for automatically dispensing chemicals into the well bore of a well, comprising:

an elongate length of pipe having upper and lower ends, the lower end in communication with the well bore;

a first valve disposed in the length of pipe, proximate the lower end thereof, the first valve being normally in an open position;

a second valve disposed in the length of pipe, proximate the upper end thereof, the second valve being normally in a closed position;

each of the valves having a valve handle operable to open and close each valve;

a rotatable carrousel member disposed above and adjacent the upper end of the length of pipe, the carrousel member including a plurality of vertical tubular members radially spaced about the carrousel member and adapted to contain cylindrical sticks of chemicals; and upon rotation of the carrousel member, a tubular member is indexed and aligned with the open upper end of the length of pipe;

means for rotating the carrousel member;

a double acting cylinder and piston shaft disposed adjacent the length of pipe, the longitudinal axis of the pipe and the cylinder being substantially parallel to each other, the piston shaft having attached thereto a valve operator member which is normally disposed below and adjacent the first valve, which upon upward movement of the piston shaft, the valve operator member sequentially engages the first valve handle, the second valve handles and the means for rotating the carrousel member, to sequentially close the first valve, open the second valve, and rotate the carrousel member to permit a stick of chemicals to fall into the open end of the pipe; and which upon downward movement of the piston shaft, the valve operator member sequentially engages the second valve handle and the first valve handle, to sequentially close the second valve and open the first valve to permit the stick of chemicals to fall into the well bore.

14. The apparatus of claim 13, wherein a spring steel tine is secured to each valve handle, the spring steel tines being engaged by the valve operator member.

15. The apparatus of claim 13 wherein the means for rotating the carrousel member comprises a rotatable cam member which is engaged by the valve operator member.

16. The apparatus of claim 13 wherein an elongate, flexible projection is secured to each valve handle, the flexible projection being engaged by the valve operator member.

* * * * *

UNITED STATES PATENT AND TRADEMARK OFFICE

CERTIFICATE OF CORRECTION

PATENT NO. : 4,785,880

DATED : November 22, 1988

INVENTOR(S) : Robert Ashton

It is certified that error appears in the above-identified patent and that said Letters Patent is hereby corrected as shown below:

In Claim 8, line 1, after "means", insert --for controlling--.

In Claim 13, line 2, delete "the", and insert --a--.

In Claim 13, line 35, delete "handles", and insert --handle--.

Signed and Sealed this

Eleventh Day of February, 1992

*Attest:*

HARRY F. MANBECK, JR.

*Attesting Officer*

*Commissioner of Patents and Trademarks*